US005647758A

United States Patent [19]

Ichikawa et al.

[11] Patent Number: 5,647,758

[45] Date of Patent: Jul. 15, 1997

[54] ELECTRICAL CONNECTOR ASSEMBLY WITH BIASED GUIDE MEANS

[75] Inventors: Shozou Ichikawa, Kawasaki; Naoya Matsuura, Yokohama, both of Japan

[73] Assignee: Molex Incorporated, Lisle, Ill.

[21] Appl. No.: 584,664

[22] Filed: Jan. 11, 1996

[30] Foreign Application Priority Data

Feb. 23, 1995 [JP] Japan ..... 5-059897

[51] Int. Cl.[6] ..... H01R 13/627

[52] U.S. Cl. ..... 439/362; 439/364; 439/953

[58] Field of Search ..... 439/362, 364, 439/365, 377.2, 378, 379, 380, 381, 677, 680, 953

[56] References Cited

U.S. PATENT DOCUMENTS

| | | | |
|---|---|---|---|
| 3,582,867 | 6/1971 | Thompson et al. | 439/362 |
| 3,718,887 | 2/1973 | Solomon et al. | 439/362 |
| 4,577,919 | 3/1986 | Waters | 439/362 |
| 5,092,774 | 3/1992 | Milan | 439/378 |
| 5,213,532 | 5/1993 | Mee | 439/364 |
| 5,391,091 | 2/1995 | Nations | 439/378 |

OTHER PUBLICATIONS

Continental Connector, Electronics, p. 34, Sep. 11, 1959.

*Primary Examiner*—David L. Pirlot
*Assistant Examiner*—Tho Dac Ta
*Attorney, Agent, or Firm*—Charles S. Cohen

[57] ABSTRACT

An improved electrical connector assembly includes interengaging plug and receptacle connector components. One of the connector components is equipped with engagement screws, and the other connector component is equipped with screw-receiving cavities which engage the engagement screws. Each engagement screw has a guide portion in the form of a projecting guide pin fixed to its tip which projects past an endface of the one connector so as to provide a pair of alignment members which are received within the other connector cavities prior to mating of the plug and receptacle components together.

With this arrangement, the exact alignment of the plug and receptacle connectors is permitted by inserting the engagement screws in the cavities prior to the mating of these connectors, thereby eliminating the possibility of interference between opposing male and female terminals of the two connector components which would cause damage to the terminals and the connector components.

20 Claims, 5 Drawing Sheets

ELECTRICAL CONNECTOR ASSEMBLY WITH BIASED GUIDE MEANS

BACKGROUND OF THE INVENTION

The present invention relates generally to an electrical connector assembly and more particularly to a plug and receptacle connector assembly having biased guide means.

Electrical connector assemblies which utilize plug and receptacle connectors are well known in the art. Typically, these connectors are used on the ends of cables which mate with and provide an interface, or input/output connection with computers or other electronic devices. These type of connectors include a large number of contacts which must be properly mated together to ensure proper connection of the circuits. In order to retain the plug and receptacle components together when interengaged together, one of the plug and receptacle components (typically the plug component) is equipped with screws which extend forwardly of the plug component and which are received in threaded holes formed with the receptacle component. After the plug and receptacle components are mated together, the screws are turned to engage the holes of the receptacle component to keep the plug and receptacle components of the connector assembly in an engaged, mating condition.

U.S. Pat. No. 5,219,301 issued Jun. 15, 1993, discloses an electrical connector assembly in which the receptacle component has threaded holes which receive the threaded heads of screws of the plug component. The threaded holes have a cylindrical outer guide portion with a key therein which receives keyways formed in the opposing threaded screws so that the male and female connector components may be aligned together and identified in terms of the keys and keyways. The bores have axial keys formed thereon which received within keyways of the pins in order to provide alignment between the two connector components.

However, in using this type of electrical connector assembly, the connector plug and receptacle components are mated together before engaging the screws into the threaded holes. It is therefore likely that the terminals of the connector plug and receptacle components may be put into an incorrect mating position, thus causing undesired interference therebetween and sometimes deforming some of the male and female terminals and even damaging the connector plug or receptacle components.

In this electrical connector assembly, the holes and screws make up a guiding mechanism, but the mating of the male and female connectors is effected simultaneously with the coupling of the screws in the threaded holes, and therefore, interference or misalignment between the connector component male and female terminals cannot be completely eliminated. Also, such an electrical connector assembly disadvantageously requires extra parts such as the keys and the keyways formed therein.

Another style of plug-receptacle connector assembly is disclosed in U.S. Pat. No. 4,998,892, issued Mar. 12, 1991 wherein the plug component of the connector assembly is provided with two axially extending guide pins which are received in corresponding alignment cavities formed in the opposing receptacle component. These guide pins project forwardly of the plug component leading edge but do not firmly encounter the receptacle component alignment holes/openings until such time as the male and female terminals of the connector components are engaged together and thus, the possibility of misalignment between the plug and receptacle components exists.

With the increasing emphasis being currently placed on the reduction in size of electronic devices, interfacing and connecting cables are required to carry more circuit wires and the connectors associated with such cables are also required to accommodate more circuits. More circuits in a connector assembly mandates smaller contacts. Smaller contacts are more fragile and more susceptible to damage when the connector components are misaligned in their engagement with each other, and thus a need exists for an electrical connector assembly with a guide means which aligns the connector components together prior to mating of the connector components together.

The present invention is therefore directed to an electrical connector assembly with an improved guide means which substantially ensures proper alignment and mating of opposing, interengaging connector components in a manner which reduces the risk of misalignment between the terminals of the connector components.

SUMMARY OF THE INVENTION

It is therefore an object of the present invention to provide an electrical connector assembly with a mechanism for guiding the opposing connector components into alignment prior to the engagement thereof.

Another object of the present invention is to provide an electrical connector assembly having interengaging male and female connector components which overcomes the aforementioned disadvantages of the prior art and which establishes correct alignment of the male and female terminals of the connector components prior to mating the male and female connector components together.

Yet another object of the present invention is to provide an improved electrical connector assembly having interengaging plug and receptacle connector components in which one of the two connector components includes an alignment means in the form of threaded guide pins which are axially received within associated cavities formed in the other connector component and which are biased by associated springs, the springs providing a means for urging the guide pins into aligned contact with opposing connector component threaded holes.

To attain these objects and advantages, an electrical connector assembly constructed in accordance with the principles of the present invention may include two interengaging plug and receptacle connector components which are mated together. One of the plug and receptacle components has a set of engagement screws while the other component has corresponding screw locks in the form of threaded holes which receive and couple with the screws. Each of the screws has a guide pin portion disposed near or at its forward tip, while each screw lock may include a tapered opening which defines an entrance for the screw which facilitates in leading the guide pin to the center of the screw lock.

The screw pins may project forwardly from the front end of the one connector and may be spring-biased so that they project ahead of the front of the connector into an engagement position. The other connector may have cavities which are aligned with the screws, the cavities containing tapped sections which receive threaded portions of the one connector pins, and tapered entrances and extensions of the cavities which receive the guide pins of the screws.

The plug and receptacle connectors of an electrical connector assembly according to the present invention can be put into a correct mating position by inserting the guide pins into the screw locks prior to any mating of the plug and receptacle connectors. The guide pin can be advantageously made integral with the connector screws, and therefore, no additional parts are required.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DESCRIPTION OF PREFERRED EMBODIMENTS

Figure 1:
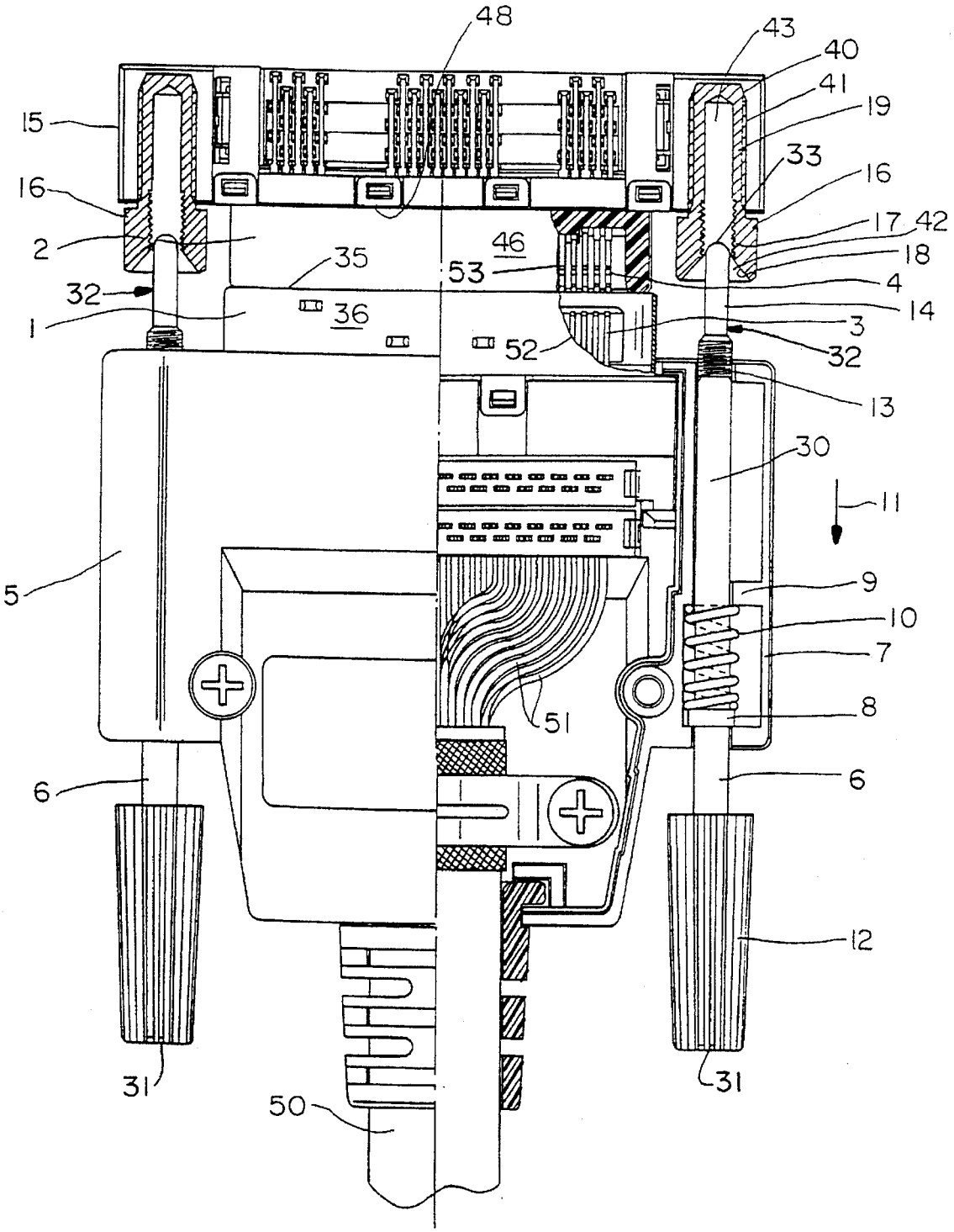
FIG. 1 is a plan view, partially in section, of one embodiment of an electrical connector assembly constructed in accordance with the present invention, shown aligned together prior to engagement of the plug and receptacle connector components.
Figure 2:
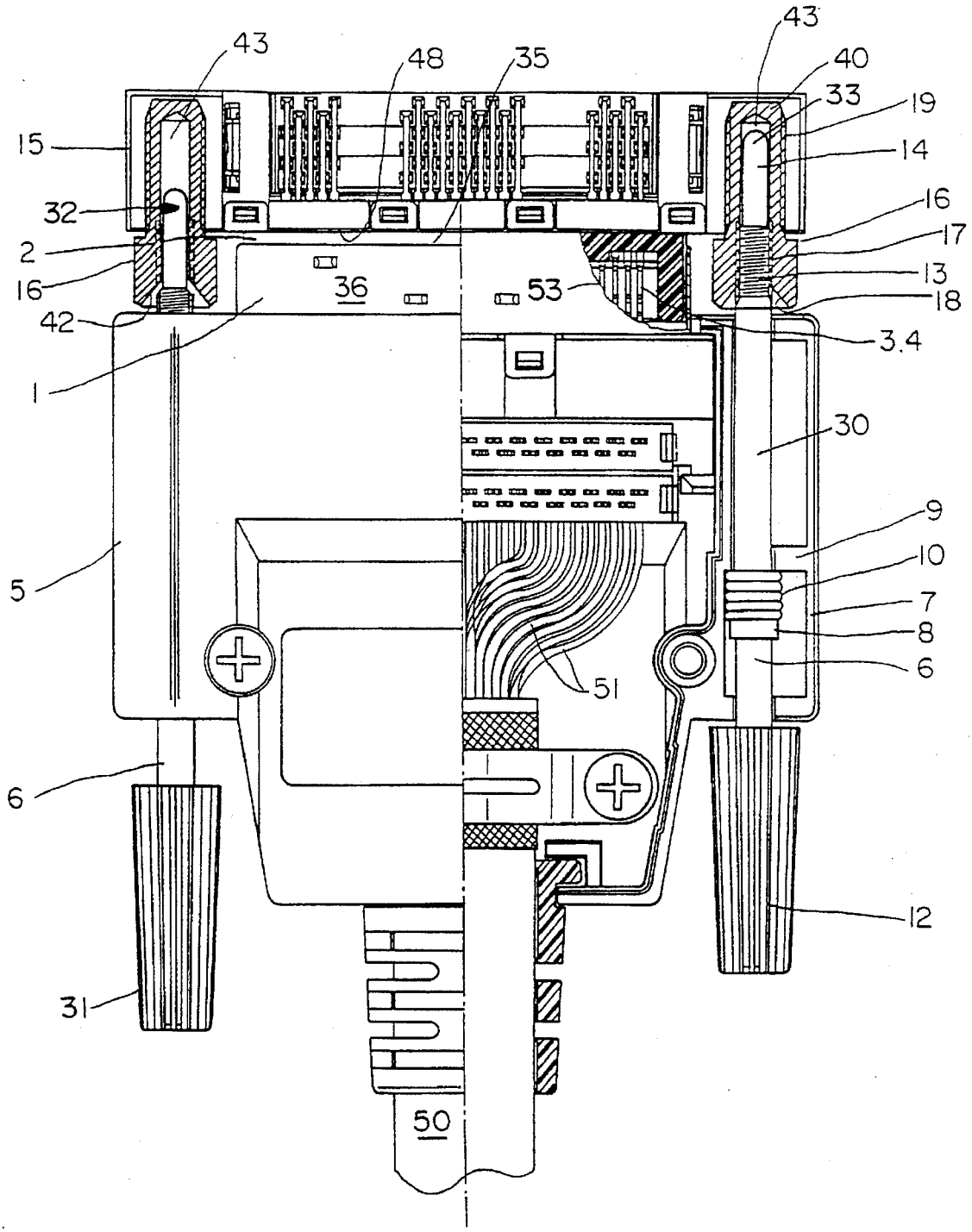
FIG. 2 is a plan view, partially in section, of the electrical connector assembly after the plug and FIG. 1 receptacle connector components are engaged together.

Referring to FIGS. 1 and 2, a first embodiment of an electrical connector assembly constructed in accordance with the principles of the present invention is shown as comprising a plug component 1 and a receptacle component 2. The two components are intended to be mated together, as is known in the art in a manner in which a first array 52 of electrical contacts, or terminals 3, of the plug component are mated with an opposing second array 53 of electrical terminals 4 of the receptacle component 2. Such a connector assembly is useful for providing an interconnection between an interface cable 50 and an electronic device, such as a computer (not shown). Such a connection must provide an effective connection between multiple circuit wires 51 of the cable 50 and corresponding circuits of the computer.

The plug connector 1 is enclosed within an exterior housing in the form of a casing 5, which has a pair of engagement pins 6 held therewithin on opposite sides of the plug connector component. The engagement pins 6 include elongated shaft or body portions 30 and preferably, threaded portions 13, by which they may engage the receptacle component 2 in a manner known in the art. Each such plug component engagement pin 6 is rotatably supported within the housing 5 by means of a bearing member 7 disposed within the housing 5. Each engagement pin 6 is axially slidable within the bearing 7.

The engagement pins 6, in accordance with the present invention, each have a biasing means associated therewith, illustrated in FIGS. 1 & 2 as coil springs 10 disposed on and surrounding the shaft portions 30 of the engagement pins 6. The springs 10 are disposed on the shaft portions 30 between a collar or stop member 8 affixed to the engagement pin shaft portions 30 and opposing endwalls 9 of the bearing member 7. In the embodiment illustrated in FIGS. 1 & 2, the springs 10 are placed under tension within the plug connector housing 5 in a manner so that engagement pins 6 are biased rearwardly by the spring in the direction indicated by arrow 11 shown at the right of FIG. 1. In this regard, the springs 10 may include compression springs disposed forwardly of the collar 8.

To facilitate manipulation of the engagement pins 6 by a user, the engagement pins 6 may include enlarged rear end portions, shown as thumbpieces 12, containing a series of exterior corrugations 31 by which a user may easily grasp the pin 6 and rotate it in a desired direction in order to engage or disengage the pins 6 with the opposing cavities 16 of the receptacle connector component 2.

The threaded portions 13 of the engagement pins 6 are disposed forwardly of their corresponding shaft portions 30, proximate to the front ends 32 of the engagement pins 6. A guide portion 14 of the engagement pin 6 is preferably formed at the front end 32 of each engagement pin 6 and extends forwardly of the threaded portion 13 thereof. This guide portion 14 may be integrally connected to the threaded portions 13 of the pins 6 when the engagement pin is formed as one piece from a single shaft by suitable machining methods. However, it is envisioned that the guide portions 14 of the pins 6 may also be formed separately from the engagement pin shaft portions 30 and take the form of a separate guide pin which is held within a suitable recess (not shown).

Importantly, the guide portions 14 of the engagement pins 6 extend ahead of the threaded portions 13 thereof and ahead of an endface 35 of an engagement shield 36 which surrounds and partially encloses the first array 52 of terminals 3 held by the plug connector 1. A similar engagement shield 46 extends out from a base portion 48 of the second connector component 2 and surrounds and partially encloses the second array 53 of terminals in the receptacle connector component 2. When the two connector components 1, 2 are joined together as depicted in FIG. 2, the first connector component endface 35 confronts and may often abut the second connector component base portion 48. The guide portions 14 increase the overall length of the engagement pins 6 so that the engagement pins 6 may become aligned with the cavities 16 of the receptacle connector 2. Each guide portion 14 may have a rounded or blunt tip 33 which facilitates entry thereof into a confronting receptacle connector component 2 as will be explained in greater detail below.

The receptacle component 2 has a similar exterior housing, shown as a casing 15 which contains a pair of cavities 16, on opposite sides of the receptacle component 2. These cavities 16 are positioned on the receptacle connector 2 and in the casing 15 thereof, so that they are aligned with the pins 6 of the plug connector components 1 when the plug and receptacle components 1 & 2 are put in an aligned, confronting position. In this regard, it is preferable to have the center-to-center distance between the receptacle connector component cavities 16 equal the center-to-center distance between the plug connector component guide pins 6.

Each receptacle connector component cavity 16 may be formed directly in the receptacle component casing 15, or may be formed within a pair of inserts 40 which are held within a pair of bores 41 of the receptacle component 2. The cavities 16 are generally cylindrical and include tapped, or threaded portions 17, disposed therein which receive and threadedly engage the opposing threaded portions 13 of the plug connector engagement pins 6. In this regard, the cavities 16 serve to lock the engagement pins 16 in place so that the plug and receptacle components will fully engage each other and as such the cavities 16 may be considered as screw locks.

As mentioned above, each of the cavities 16 may include a tapered entry portion 42 disposed forwardly of the threaded portions 17 which define entrances to the cavities locks 16 and may include diverging sidewalls, as indicated at 18. Rearward of the threaded portions 17, the inserts 40 may include reduced-diameter portions 19 which are embedded in the receptacle component 2 and extend into its casing 15 in order to define hollow guide portion-receiving recesses 43 which receive the guide portions 14 of the engagement pins 6.

In coupling the plug and receptacle connector components 1 & 2 together, the connector components are placed into an opposing, confronting position and brought together so that the guide portions 14 of the plug component engagement pins 6 oppose the cavities 16 of the receptacle component at the entry portions 42 thereof. The tapered walls 18 of the cavities 16 will urge the projecting guide portions 14 of the engagement pins 6 into substantially exact alignment with the centers axes of the cavities 16, thus automatically putting the plug and receptacle connectors 1 and 2 in exact alignment so that the engagement shield of one of the connector components will engage the shield of the other connector component. In this alignment position, the plug and receptacle connectors 1, 2 can subsequently be mated together without fear of causing substantial detrimental interference between the terminals 3, 4 of the first and second arrays 52, 53 of terminals of the plug and receptacle components 1&2. Thus, the terminals and connector components can be prevented from being damaged due to misalignment of the connector components.

The springs 10 provide a rearward bias to the engagement pins 6, but because of the position of the guide portions 14 and the overall length of the engagement pins 6, the front ends 32 of the engagement pin guide portions 14 still project past the endface 35 of the plug connector component 1. The user must push them forwardly by way of the thumbpieces 12 so that they extend deeper into the receptacle cavities 16 than the extent depicted in FIG. 1 and they thereupon reach the extent depicted in FIG. 2.

Referring to FIG. 2, the plug and receptacle connectors 1 and 2 are illustrated as mated together, and these connectors 1 and 2 are positively held in the mating condition by pressing in the engagement pins 6 and by rotating the thumb pieces 12 of the engagement pins 6 in order to engage the pin threaded portions 13 with the threaded portions 17 of the cavities 16.

Figure 3:
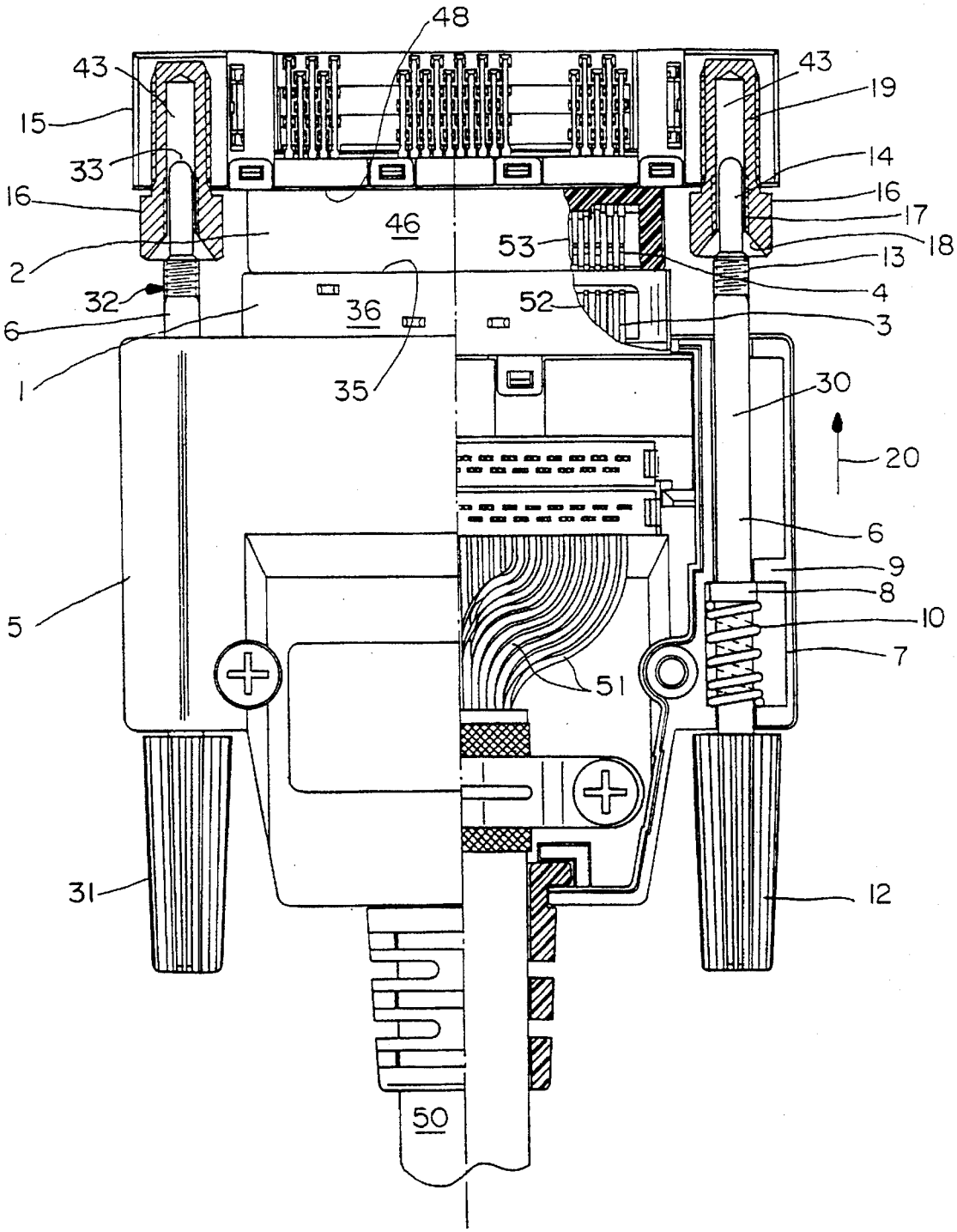
FIG. 3 is a plan view, partially in section, of a second embodiment of a electrical connector assembly constructed in accordance with the present invention shown prior to engagement of the plug and receptacle connector components.
Figure 4:
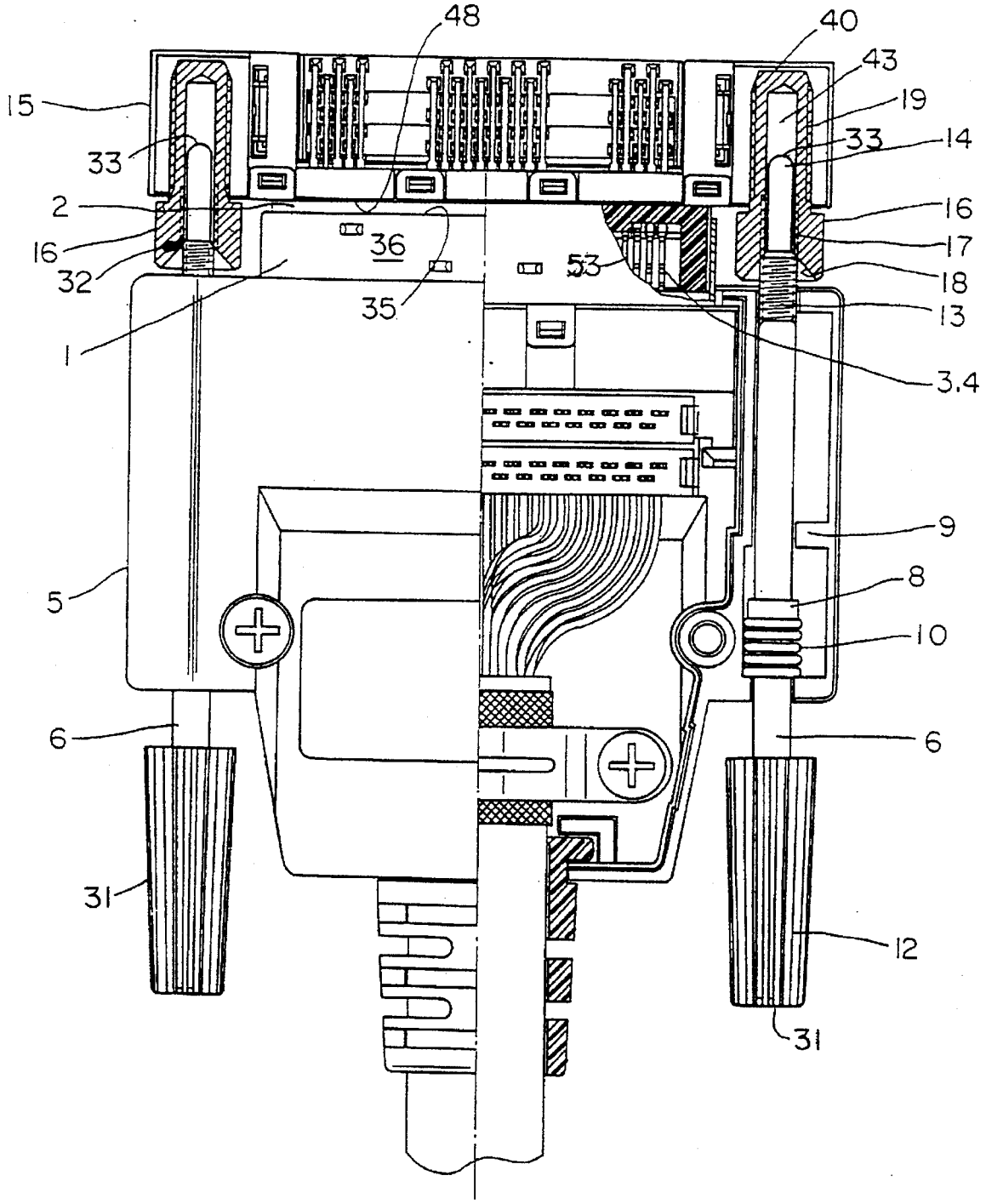
FIG. 4 is a plan view, partially in section of the electrical connector assembly of FIG. 3 shown after the engagement of the plug and receptacle connector components.
Figure 5:
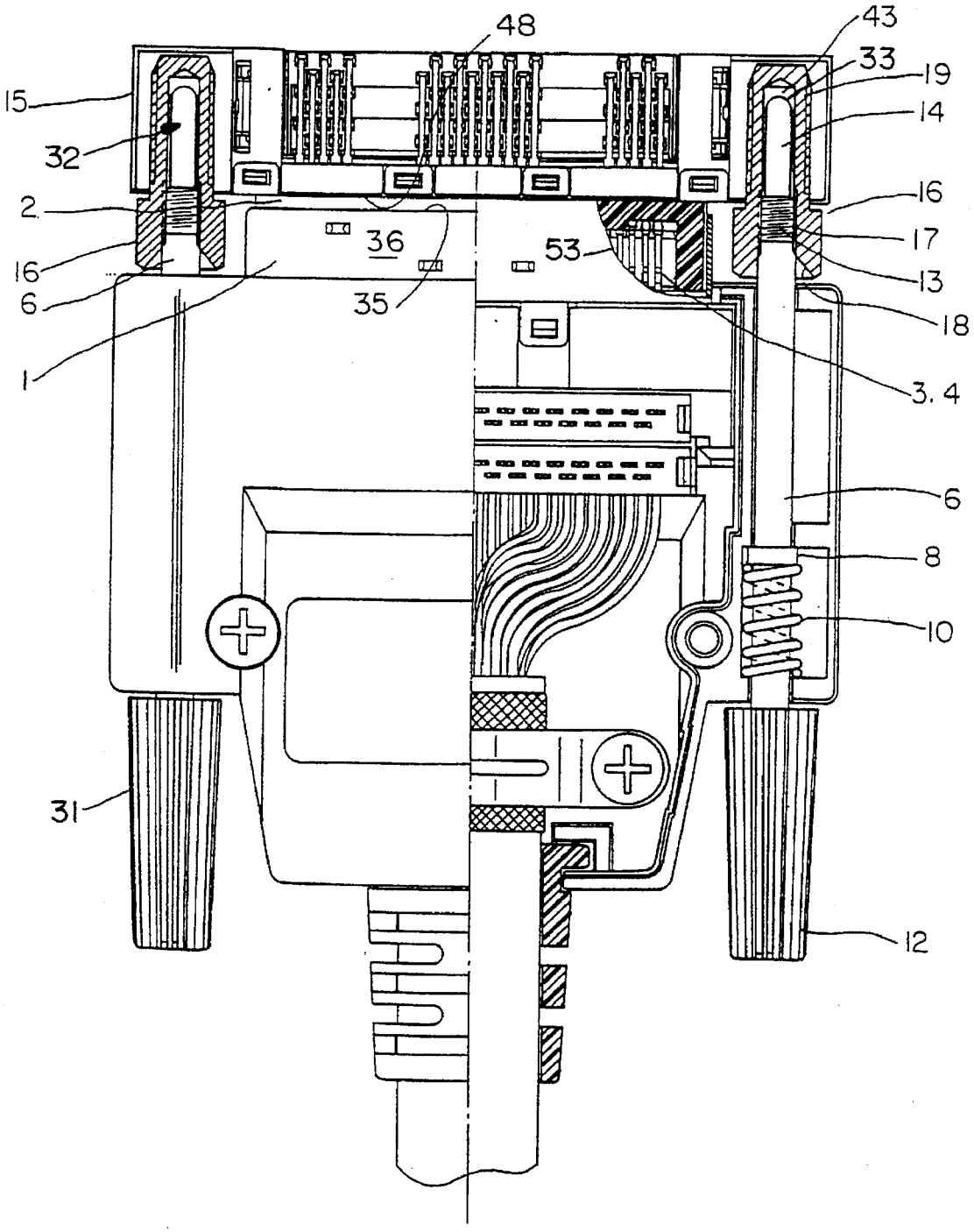
FIG. 5 is a plan view, partially in section, of the electrical connector assembly of FIG. 3, in which the plug and receptacle component are fully engaged.

Referring now to FIGS. 3 to 5, a second embodiment of an electrical connector assembly in accordance with the present invention is illustrated and is composed of generally the same elements as in the first embodiment. The second embodiment differs from the first embodiment in that each engagement pin 6 is spring-biased forwardly in the direction indicated by arrow 20 (opposite to the direction of the first embodiment). In order to accomplish this, the engagement pin collars 8 are disposed forwardly of the compression springs 10 on the engagement pin shaft portions 30 so that the collars 8 provide surfaces against which the front ends of the springs 10 bear against and may compress. The rear ends of the springs 10 abut against the rear surfaces of the bearing 7.

In coupling the plug component 1 to the receptacle component 2, the components are placed into an exact alignment position by leading the engagement pins 6 into the cavities 16, thereby permitting the mating of these plug and receptacle connector components without fear of causing significant interference between the plug and receptacle components and their respective terminals. FIG. 4 illustrates how the plug and receptacle connectors are put into a complete mating position. As is the case with the first embodiment, these connectors 1 and 2 are positively held in the mating position by rotating the thumbpieces 12 of the engagement pins 6 so that the threaded portions 13 of the engagement pins 6 engage the threaded portions 17 of the receptacle cavities 16, as seen from FIG. 5.

In each embodiment, the engagement pin forward guide portions 14 are inserted into rear recesses 43 of the cavities 16, and therefore, the engagement pins 6 may be made of a metal because they are isolated from the surrounding wires or electronic parts by the insert 40. Furthermore, the engagement pins 6 are preferably positioned on the plug connector component 1 in a center-to-center spacing which is substantially equal to the center-to-center spacing of the receptacle connector component cavities 16.

In the embodiments described above, the plug component 1 is described as having engagement pins 6 and the receptacle component 2 is described as having cavities 16. Conversely, the plug component 1 may contain the cavities, and the receptacle component 2 may include the engagement pins so long as the center-to-center distance between them is approximately the same. Also, the cavity recesses 43 may not have a bottom end portion as illustrated, but may be open to the rear of the casing 15.

As may be understood from the above, the electrical connector assembly of the present invention permits the exact alignment of the plug and receptacle connectors by permitting a user to insert the connector component engagement pins in the receptacles prior to the mating of the connectors, thereby eliminating the possibility of interference between the male and female terminals, which would cause the damaging of terminals and connector bodies. The electrical connector assembly according to the present invention requires no extra parts to assure no interference between the male and female terminals.

It will be appreciated that the embodiments of the present invention discussed herein are merely illustrative of a few applications of the principles of the invention. Numerous modifications may be made by those skilled in the art without departing from the true spirit and scope of the invention.

We claim:

1. In an electrical connector assembly of the type having first and second interengaging connector components, the first and second connector components including respective first and second arrays of contact terminals disposed thereon, said first connector component including a pair of engagement screws disposed on opposite sides of said first terminal array, the second connector component including a pair of screw-receiving cavities disposed on opposite sides of the second terminal array which receive said first connector component engagement screws when said first and second connector components are engaged together, the improvement comprising: means for aligning said first and second connector components together in a confronting relationship wherein said first and second terminal arrays are aligned with each other prior to engagement of said first and second connector components, the alignment means including guide portions projecting from said first connector component engagement screws and said alignment means further including entrance openings surrounding said screw-receiving cavities which include tapered portions for guiding said engagement screw guide portions into said screw-receiving cavities and substantially centering said engagement screws therein, the guide portions of said engagement screws protruding past an endface of said first connector component such that they extend forwardly of said first connector components and are received within said second connector component screw-receiving cavities prior to said first and second connector components engaging each other when said first and second connector components are brought together to establish an electrical connection therebetween.

2. The electrical connector assembly as defined in claim 1, wherein each of said screw-receiving cavities includes a generally cylindrical bore having a tapered entrance surrounding the bore, said bore having an internal threaded portion disposed rearwardly of said entrance and an elongated recess portion disposed rearwardly of said threaded portion, the recess portion receiving said engagement screw guide portions when said engagement screws are fully inserted into said screw-receiving cavities.

3. The electrical connector assembly as defined in claim 1, wherein said first connector component includes an exterior housing and said engagement screws extend through said first connector component housing, said engagement screw guide portions being disposed on said engagement screws at forward ends thereof, exterior of said first connector component housing and past a front endface thereof, whereby said guide portions engage said screw-receiving cavity opening tapered portions prior to said first and second terminal arrays engaging each other when said first and second connector components are brought together to establish an electrical connection therebetween, said engagement screws further including enlarged head portions at their rear ends thereof and disposed exterior of said first connector component housing, the head portions providing a means by which said engagement screws may be manipulated by a user.

4. The electrical connector assembly as defined in claim 1, wherein said engagement screw guide portions are disposed on opposite sides of said first terminal array in a first center-to-center spacing and said screw-receiving cavities are disposed on opposite sides of said second terminal array in a second center-to-center spacing, said first and second center-to-center spacings being approximately equal.

5. The electrical connector assembly as defined in claim 1, said screw-receiving cavities are formed within inserts held within said second connector component.

6. The electrical connector assembly as defined in claim 1, wherein said engagement screws include threaded portions disposed rearwardly of said guide portions which threadedly engage said screw-receiving cavities to thereby lock said first and second connector components together.

7. The electrical connector assembly as defined in claim 6, wherein said screw-receiving cavities each include a tapered entrance portion and a recess portion, said threaded portion being disposed between said entrance and recess portions.

8. The electrical connector assembly as defined in claim 1, wherein each of said engagement screws includes an elongated shaft member having a threaded portion disposed rearwardly of said guide portions for engaging said screw-receiving cavities, the shaft member further having a shaft body portion held within a bearing, the shaft body portion having a stop member disposed thereon, said alignment means further including means for biasing said engagement screw guide portions past said first connector component endface, said biasing means includes a spring disposed on said shaft body portion between said stop member and the bearing, said spring applying a biasing force to said shaft member to bias said engagement screw into a preselected position.

9. The electrical connector assembly as defined in claim 8, wherein said stop member is disposed on said shaft body portion rearwardly of said spring such that said spring biases said engagement screw forwardly within said first connector component.

10. The electrical connector assembly as defined in claim 8, wherein said first connector component is a plug connector component and said second connector component is a receptacle connector component.

11. The electrical connector assembly as defined in claim 8, wherein said stop member is disposed rearwardly of said bearing and forwardly of said spring such that said spring biases said engagement screw rearwardly within said first connector component.

12. An electrical connector assembly comprising: a first connector component having a plurality of first contact terminals disposed thereon in a first terminal array, a second connector component having a plurality of second contact terminals disposed thereon in a second terminal array, each of the first and second connector components having respective first and second housings which at least partially enclose said connector components, said first connector component having an endface which defines an imaginary line perpendicular to said first terminal array beyond which said first terminal array does not extend, said second connector component having a base which is disposed substantially perpendicular to said second terminal array and which confronts said first connector component endface when said first and second connector components are joined together to establish an electrical connection therebetween, said first connector component having a pair of engagement pins disposed therein on opposite sides of said first terminal array, said second connector component including a pair of engagement cavities disposed therein on opposite sides of said second terminal array, each of said engagement pins including an elongated shaft portion, a threaded portion and a guide portion, the guide portions being disposed forwardly of said threaded portions, said engagement pin guide portions projecting beyond said first connector component endface such that said guide portions are at least partially received within said second connector component cavities prior to engaging together said first and second terminal arrays of said first and second connector components when said first and second connector components are joined together, each of said engagement pins including a biasing spring associated therewith and disposed on said elongated shaft portion within said first housing, the spring being compressible between said first housing and a stop disposed on said engagement pin shaft portion and located within said first housing, to thereby exert a biasing force upon said engagement pin and maintain said guide portions forward of said first connector component endface.

13. The electrical connector assembly as defined in claim 12, wherein said engagement pin guide portions are disposed on opposite sides of a centerline of said first connector component in a first center-to-center spacing and said engagement cavities are disposed on opposite sides of a centerline of said second connector component in a second center-to-center spacing, said first and second center-to-center spacing being approximately equal to each other.

14. The electrical connector assembly as defined in claim 12, wherein said engagement pins include enlarged gripping portions disposed rearwardly of said first terminal array by which a user may manipulate said engagement pins.

15. The electrical connector assembly as defined in claim 12, wherein said first connector component is a plug connector component and said second connector component is a receptacle connector component.

16. The electrical connector assembly as defined in claim 12, wherein said engagement pin stop includes an annular collar disposed on said shaft portion.

17. The electrical connector assembly as defined in claim 16, wherein said springs are disposed on said engagement pin shaft portions rearwardly of said collars and exert a forward biasing force on said engagement pins.

18. The electrical connector assembly as defined in claim 16, wherein said springs are disposed on said engagement pins forwardly of said collars and exert a rearward biasing force on said engagement pins.

19. An electrical connector assembly comprising:

a first connector component having a plurality of first contact terminals disposed thereon, the first connector component having an endface which extends perpendicular to said first contact terminals, said first contact terminals having a length which does not extend said beyond first connector component endface, said first connector component including a pair of engagement pins disposed on opposite sides of said first contact terminals;

a second connector component having a plurality of second contact terminals disposed thereon, the second connector component having a base which is substantially perpendicular to said second contact terminals and which confronts said first connector component endface when said first and second connector components are joined together to establish an electrical connection therebetween, said second connector component including a pair of engagement cavities disposed therein on opposite sides of said second contact terminals, each of said engagement cavities including a tapered entrance portion disposed therein proximate to an endface of said second connector component and a recess portion disposed in alignment with and rearwardly of said tapered entrance portion;

each of said first connector component engagement pins including an elongated shaft portion, a threaded portion and a guide portion, the engagement pin guide portions being disposed forwardly of said threaded portions, said engagement pin guide portions projecting beyond said first connector component endface such that said guide portions are directed by said tapered entrance portions toward said second connector component cavity recess portion and are at least partially received within said recess portions prior to engaging together said first and second connector components to thereby align said first contact terminals with said second contact terminals prior to joining said first and second connector components together in an electrically conductive relationship; and, means mounted upon said engagement pins for biasing said engagement pin guide portions beyond said first connector component endface.

20. In an electrical connector assembly of the type having first and second interengaging connector components, the first and second connector components including respective first and second arrays of contact terminals disposed thereon, said first connector component including a pair of engagement screws disposed on opposite sides of said first terminal array, the second connector component including a pair of screw-receiving cavities disposed on opposite sides of the second terminal array which receive said first connector component engagement screws when said first and second connector components are engaged together, the improvement comprising: means for aligning said first and second connector components together in a confronting relationship wherein said first and second terminal arrays are aligned with each other prior to engagement of said first and second connector components, the alignment means including guide portions projecting from said first connector component engagement screws, the guide portions protruding past an endface of said first connector component such that they extend forwardly of said first connector components and are received within said second connector component screw-receiving cavities prior to said first and second connector components engaging each other when said first and second connector components are brought together to establish an electrical connection therebetween, said engagement screws including threaded portions disposed rearwardly of said guide portions and each of said screw-receiving cavities including a generally cylindrical bore having a tapered entrance surrounding the bore, said engagement screws including springs disposed thereon for applying a biasing force to said engagement screws to maintain said guide portions in their extent past said first connector component endface, said bore having an internal threaded portion disposed rearwardly of said tapered entrance and said bore further having an internal, elongated recess portion disposed rearwardly of said threaded portion, the recess and threaded portions of said bores simultaneously respectively receiving said engagement screw guide and threaded portions therein, when said engagement screws are fully inserted into said screw-receiving cavities.

* * * * *